United States Patent [19]

Pearce

[11] 4,396,352

[45] Aug. 2, 1983

[54] PITCH ADJUSTMENT FOR BLADES OF CEILING FAN

[75] Inventor: Richard A. Pearce, Memphis, Tenn.

[73] Assignee: TRW Inc., Cleveland, Ohio

[21] Appl. No.: 284,319

[22] Filed: Jul. 17, 1981

[51] Int. Cl.[3] ..... F04D 29/36

[52] U.S. Cl. ..... 416/206; 416/5

[58] Field of Search ..... 416/205, 206, 207, 5

[56] References Cited

U.S. PATENT DOCUMENTS

| | | | |
|---|---|---|---|
| 425,449 | 4/1890 | Nickum . | |
| 425,585 | 4/1890 | Seymour, Jr. . | |
| 427,375 | 3/1890 | Smith et al. . | |
| 446,584 | 2/1891 | Nickum . | |
| 1,241,245 | 9/1917 | Parker . | |
| 1,362,036 | 12/1920 | Parker . | |
| 1,384,672 | 7/1921 | Murray . | |
| 1,479,895 | 1/1924 | Colby . | |
| 1,485,552 | 3/1924 | Colby | 416/206 |
| 1,509,601 | 9/1924 | Johnson et al. | 416/206 |
| 1,685,323 | 9/1928 | Hansen . | |
| 1,856,017 | 4/1932 | Baker . | |
| 1,935,314 | 11/1933 | Finch et al. . | |
| 3,799,699 | 3/1974 | Master et al. . | |
| 3,904,314 | 9/1975 | Pedersen | 416/206 X |
| 4,140,435 | 2/1979 | Huber . | |

FOREIGN PATENT DOCUMENTS

| | | | |
|---|---|---|---|
| 1189060 | 9/1959 | France | 416/206 |

*Primary Examiner*—Harvey C. Hornsby
*Assistant Examiner*—Shewen Bian
*Attorney, Agent, or Firm*—Biebel, French & Nauman

[57] ABSTRACT

Two position fan blade attachments or blade iron assemblies for sealing fans provide for the individual adjustment of the paddle-type blades into two preselected angular positions providing for either a downward or upward flow of air. The blade attachments provide detents or interengaging locking cams which are maintained in either one of the preselected positions by a spring and by the centrifugal force applied to the blade. In one embodiment, the interengaging structure includes a leaf spring which has two recesses or openings engageable with a ball. In another embodiment pairs of inclined ramps are mutually engageable with corresponding pairs of camming recesses. Pushing the blade inwardly releases the engagement and permits rotation of the blade iron into the other of the preselected positions and release thereof permits movement into a second interlocking and camming position under the influence of the spring and centrifugal force to maintain a noise-free and vibration-free connection between the blade iron and the blade iron support.

5 Claims, 10 Drawing Figures

FIG-4
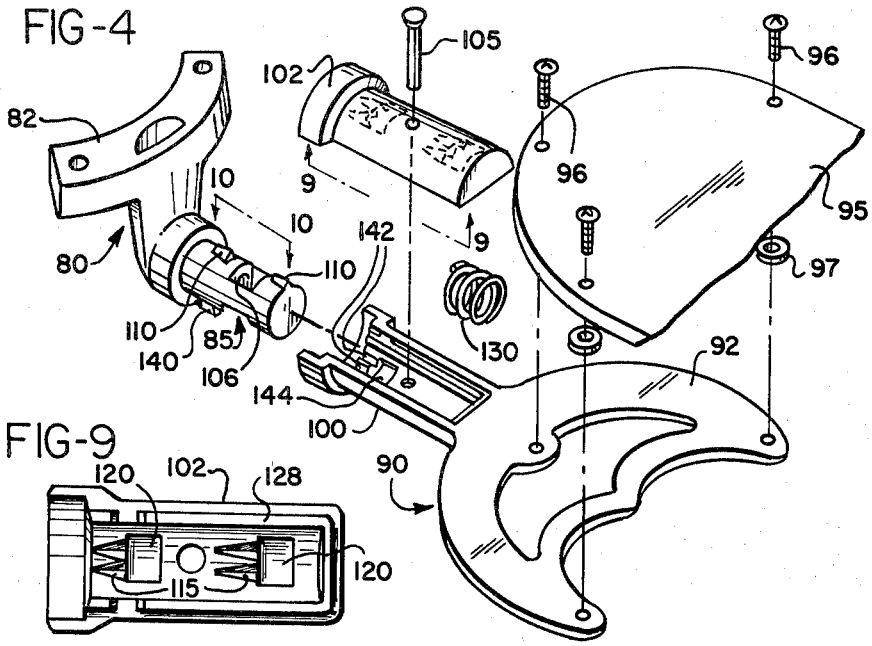
FIG-9
FIG-5
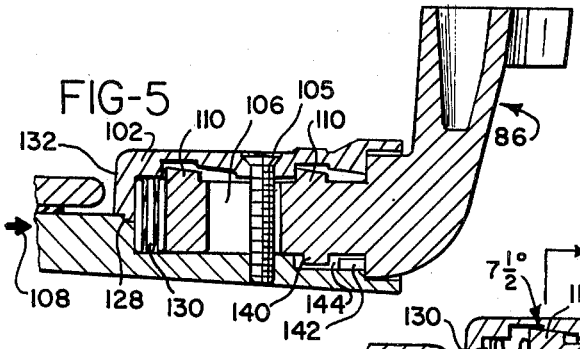
FIG-6
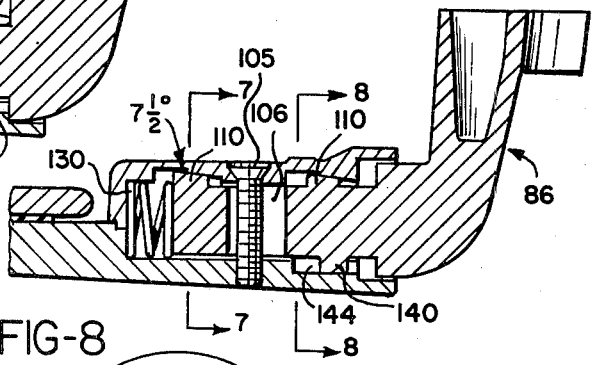
FIG-7
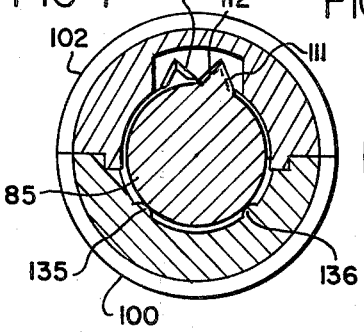
FIG-8
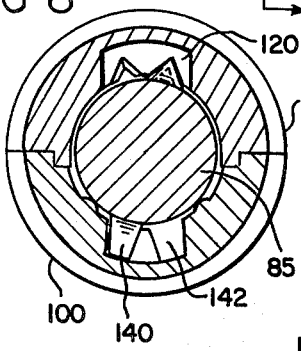
FIG-10
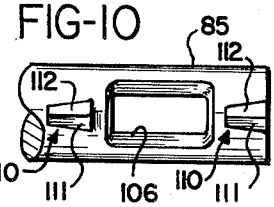

PITCH ADJUSTMENT FOR BLADES OF CEILING FAN

BACKGROUND OF THE INVENTION

This invention relates to ceiling fans and more particularly to arrangements by means of which the pitch settings of the individual blades may be selected between predetermined positions, so that a user may choose between an upward or a downward air flow.

The present invention is specifically adapted and intended to be used with ceiling type fans of the general type disclosed in the patents of Parker, U.S. Pat. No. 1,241,245 issued Sept. 25, 1917, Parker, U.S. Pat. No. 1,362,032 of Dec. 14, 1920 and Baker, U.S. Pat. No. 1,856,017 of Apr. 26, 1932. In those prior patents, arrangements are shown through which the blades may be simultaneously moved and retained in selected pitch positions.

A need has arisen for a low cost pitch selection device incorporated in the blade mounting structure of ceiling fans of the general type noted above, in which the air flow direction may be selected between two predetermined conditions with a mechanism which eliminates the costly shafts and pitch adjusting yokes, all of which required that the parts be machined to close tolerances to prevent play or loose fitting parts which otherwise could result in unwanted vibration or noise.

SUMMARY OF THE INVENTION

The present invention is directed to embodiments of a positive-engaging fan pitch selection device, providing movement of the fan blades about a radial centerline of the blades between either one of two pre-selected angular positions, while eliminating loose fits between the parts and maintaining vibration and noise-free connections over a long period of time. The centrifugal force of the blades is utilized to assure the mating together of the relatively engaging parts and the maintenance of the preselected position in such a manner as to eliminate free play and resulting vibration.

More particularly, the invention is directed to embodiments of a fan blade supporting assembly or attachment arrangement by means of which the paddle blades of a ceiling fan are attached and secured to the rotor cage or rotating armature member, including an assembly of a fan blade bracket adapted for mounting to the rotor cage with an outwardly extending blade bracket support member and a blade bracket or blade iron which has an end adapted to support a paddle type blade, and which has another end received in interfitting relation to the fan blade bracket for limited angular pitch adjusting movement about a radial center line through the blade, permitting the blade to be moved between two defined angular positions. Preferably the blades may be moved between one position in which a downward flow of air is caused by the operation of the fan and a second position in which an upward flow of air is caused by rotation of the fan motor in the same direction. The mechanism includes detent means which provide for selective mutual engagements between the blade mounting iron, as it is sometimes known, and the fan blade bracket which maintains the blade bracket and the associated paddle blade in the preselected position, which detent means is caused to be urged into an engaged and self-tightening position when centrifugal force is applied to the blades.

In one embodiment of the invention, the fan blade supporting assembly includes a detent means which includes a leaf spring carried by an extension of the blade iron and having a pair of recesses or openings therein selectively engageable with a detent ball carried on the other of the members. In a further embodiment of the invention, the blade iron member and the blade support bracket are provided with cooperating and interfitting inclined cam surfaces or interfitting wedges which are disengageable by a radial inward push on the blade, so that one of the cam surfaces moves to a clearance recess or opening on the other member, thereby permitting the selection of another angular position of the blade. Thereafter the parts are moved to another mutually engaging camming position in which the blade iron is locked in position, and the locking engagement is enhanced by the centrifugal forces applied to the blades during rotation. Preferably, in each of the embodiments, an angular locator means is provided through which the general position of the blade is defined, and which prevents inadvertent excessive rotation of the blades beyond the desired preselected positions.

It is therefore an important object of this invention to provide a blade-positioning detent mechanism for ceiling fans or the like in which paddle wheel blades may be individually moved into preselected angular positions.

A further object of the invention is to provide a selection mechanism for a blade iron for paddle wheel type fan blades which is engable upon the application of centrifugal force thereto by the fan.

A further object of the invention is the provision of a blade angle selector mechanism which is positive in operation and which eliminates any looseness of fit so that the blade supported thereon does not wobble or induce vibration to the fan.

A still further object of the invention is to provide a fan blade positioning and detent device in which a locator is movable into selected angular positions and prevent over-rotation of the fan blade beyond such positions.

These and other objects and advantages of the invention will be apparent from the following description, the accompanying drawings and the appended claims.

BRIEF DESCRIPTION OF THE DRAWINGS

FIG. 4 is an exploded perspective view of another embodiment of a blade support and blade angle adjusting mechanism according to the invention;

FIG. 5 is a longitudinal section therethrough showing the parts in the unlocked position;

FIG. 6 is a longitudinal section similar to FIG. 5 but showing the parts in the locked position;

FIG. 7 is an enlarged transverse section taken generally along the line 7—7 of FIG. 6;

FIG. 8 is an enlarged transverse section taken generally along the line 8—8 of FIG. 6;

FIG. 9 is an elevational view looking into the interior of the clamp as viewed along the lines 9—9 of FIG. 4; and FIG. 10 is a fragmentary view of the support member viewed along the lines 10—10 of FIG. 4.

DESCRIPTION OF PREFERRED EMBODIMENTS

Figure 1:
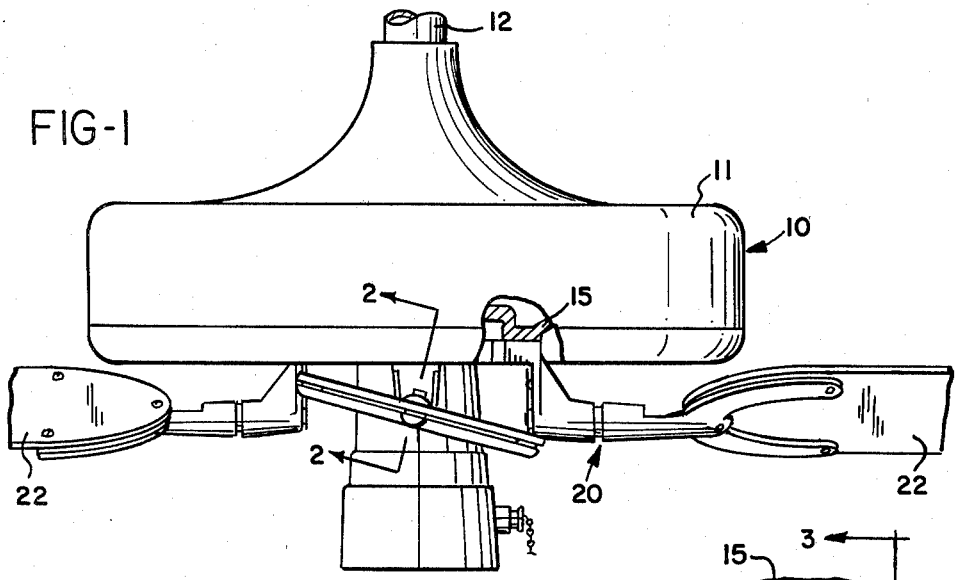
FIG. 1 is a side elevational view of a ceiling fan, with the blades being broken away, showing one form of a blade support blade angle adjusting mechanism of the present invention.

Referring to the figures of the drawing which illustrate preferred embodiments of the invention, a ceiling fan is illustrated generally at 10 in FIG. 1 as including a motor housing 11 supported on a vertical support tube 12, for hanging in depending relation from a ceiling or the like. The fan motor 10 may be constructed generally in accordance with the teachings of the above-referenced U.S. patent of Baker, U.S. Pat. No. 1,856,017 issued Apr. 26, 1932, and includes a rotor cage, a fragment of which is illustrated at 15 in FIG. 1, mounted for rotation with the motor armature. The cage 15 is provided with a generally planar and radially directed annular, lower surface 16 (FIG. 2) which provides a mounting surface for a plurality of blade support irons or blade support assemblies illustrated generally at 20 in FIG. 1. The blade assemblies 20 support at their outer ends, conventional blade paddles 22 for rotation with the rotor cage 15.

Figure 2:
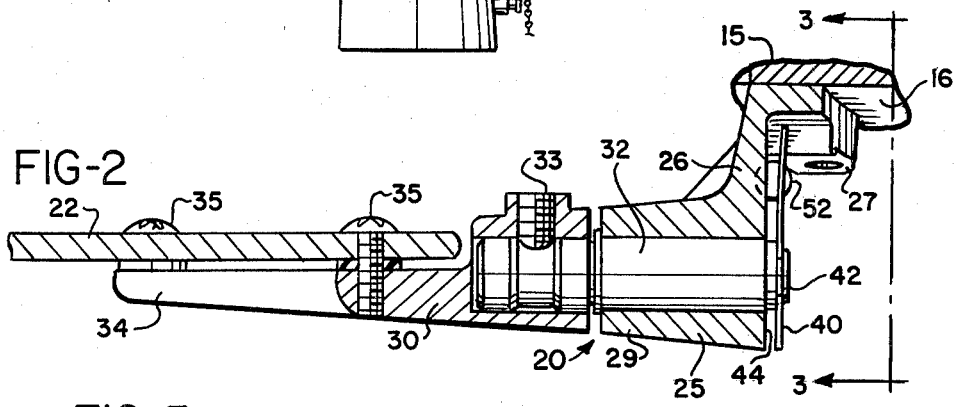
FIG. 2 is an enlarged longitudinal section through the mechanism of FIG. 1.
Figure 3:
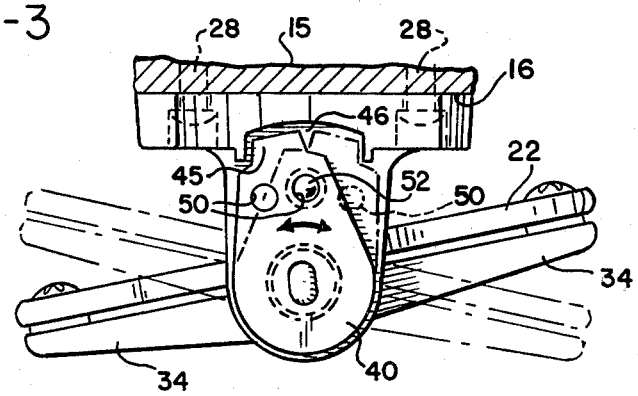
FIG. 3 is an end view looking generally along the lines 3—3 of FIG. 2.

The blade assembly 20, as illustrated in FIGS. 1–3, is particularly adapted to provide for movement of the paddle wheel fan blades 22 into either of two selectable pitch positions, such as the positions shown in full and in broken lines in FIG. 3. In a 36 inch fan these positions may be displaced from each other by approximately 24° and approximately 12° from a plane of rotation of the blades 22 on either side of such plane, to provide selectively for either an upward or downward flow of air from the blades 22.

The fan blade supporting assemblies 20, for this purpose, include a radially inner fan mounting blade bracket 25 which is formed with an upwardly directed portion 26 terminating in an upper curved end 27 of semi-arcuate shape. The end 27 is adapted to be mounted against the surface 16 of the rotor cage 15 and attached by pairs of screws 28 (FIG. 3). The fan blade mounting bracket 25 includes a body portion 29 which extends generally radially or forwardly from the upwardly directed mounting portion 26 to receive in interfitting relation a suitably configured, rearwardly extending portion of a blade mounting member or blade iron 30. In this case, the forwardly extending portion 29 is provided with a generally radially directed cylindrical aperture for rotatably receiving a rod 32 therethrough. The outer end of the rod 32 is captured by a set screw 33 in a closed or blind opening formed in the iron 30. The blade iron 30 is provided with conventionally forwardly directed arms 34 which support the blade 22 thereon as secured by screws 35.

The radially inner end of the rod 32 rotatably supports one portion of a detent means in the form of a leaf spring 40 shown in elevation in FIG. 3. The leaf spring 40 is provided with a non-circular opening through which a corresponding non-circular portion 42 of the rod extends. The rod end 42 is peened over for the purpose of fixably mounting the leaf spring 40 on the inner end of the rod. In this position, the leaf spring 40 is positioned in somewhat spaced relation to a planar rear surface 44 of the upward portion 26, and is provided at its upper end with locator means in the form of a tongue 45. The tongue 45 is captured or located within an arcuate slot or groove 46 formed in the bracket 25. The groove 46 defines with the tongue 45 the extreme limits of rotation of the blade 22, and confines the overall movement of the blade 22 to that slightly in excess of that between the full line and broken line positions shown in FIG. 3.

Detent means mutually engageable between the blade bracket 25 and the fan iron 30 for retaining the blade in either of two predetermined angular positions includes a pair of partial recesses or openings 50 formed in the leaf spring, as shown in FIG. 3, and a ball 52, of a diameter which exceeds that of the openings 50, carried in a suitable semi-spherical socket formed in the wall 44 of the bracket 25. The ball 52 is in effect captured in fixed relation to the bracket 25, and a twisting movement applied to the blade permits an inward deflection of the spring 40 past the ball 52 for the purpose of aligning either one of the pair of partial recesses or of openings 50 with the ball. Movement of the blade 22 to the broken line position, for the purpose of reversing flow, may be accomplished by applying a twisting or rotational moment to the blade 22 or to the iron 30, which applies a rotational moment to the shaft 32 accompanied by an inward deflection of the spring 40 so that the spring rotates to align the other opening 50 over the ball 52. The extended tongue 45, moving in the slot 46, prevents rotation to any position substantially beyond the detent positions defined respectively by the openings 50 and the ball 52.

It will further be seen that when the fan is operated, the centrifugal force tending to pull the blade 22 and the blade iron 30 radially outwardly will be transmitted to the shaft 32 and through the spring 40 and ball 52 to the fan blade bracket 25, and the higher the centrifugal force the greater will be the force tending to urge the spring 40 against the ball, thus holding and maintaining a preselected detent position with a minimum of free play.

The embodiment of the invention illustrated in FIGS. 4–10 incorporates a number of modifications and improvements over that shown in FIGS. 1–3, particularly in the advantageous employment of centrifugal force to maintain a tight fit between the relatively movable parts over long periods of time. It is a preferred embodiment for larger diameter fans of blades of approximately 52" in diameter, and may be advantageously used with the smaller diameter fans with blades of 36" in diameter, by reason of its superior positioning and holding accuracy, with an absolute minimum of play or looseness.

The fan blade mounting bracket 80 is adapted to be mounted to the rotating fan blade support member such as the rotor cage 15 described in the embodiments of FIGS. 1–3, and for this purpose the bracket 80 is provided with an upper arcuately shaped attachment portion 82, as shown in FIG. 4, through which a pair of attachment bolts (not shown) may extend into the rotor cage for securely retaining the bracket 80 in place on the rotor cage. The bracket 80 is provided with an integral radially outwardly extending blade iron support member illustrated generally at 85 in FIG. 4.

The blade support bracket or blade iron 90 is provided with a radially outwardly positioned flat blade supporting portion 92 by means of which a wooden paddle wheel blade 95 may be attached by retaining bolts 96 on elastomeric washers or spacers 97, as shown in the exploded view of FIG. 4. The blade iron 90 is provided with a radially inwardly extending portion or end 100 adapted to be positioned in partial interfitting relation to the radially extending support member 85, and the assembly is retained by a semi-cylindrically shaped blade iron clamp 102. A transversely-oriented retainer bolt 105 extends through a clearance opening in the clamp 102, and through an axially elongated clearance opening 106 in the member 85, into a threaded opening formed in the inwardly extending portion 100 of the blade iron 90.

The outwardly extending blade support member 85 of the blade mounting bracket 80 is formed in a generally cylindrical shape and is proportioned to form a relatively close fit respectively in the generally semi-cylindrical cavity formed by the blade iron extension 100 and corresponding cavity of the clamp 102, while permitting relative angular rotation of the blade iron 90 on the support bracket 80 when the blade iron 90 is pushed inwardly toward the bracket 80 in the direction of the arrow 108 of FIG. 5. The blade support member 85, in cooperation with the extension 100 and clamp 102, provide detent means which are mutually engageable between the bracket and the blade iron for retaining these parts in either of two preselected or predetermined angular positions. The arrangement of parts is such that the positioning adjustment may be easily effected simply by pushing in on the blade iron in the direction of the arrow 108, rotating the blade iron and associated blade to the other of its select positions and releasing the same.

The selected positions are defined in part by mutually inclined ramp or cam surfaces which interengage between the mounting member 85 and the clamp 102 to define the preselected angular positions of the blade in such a manner as to be completely free of loose play. For this purpose, the cylindrical support or mounting member 85 is provided with a radially displaced pair of outwardly extending inclined or tapered, generally V-shaped ramps 110. The ramps 110 are tapered at about 7° to 8° to a radial axis such as the 7½° angle shown (FIG. 6), so as to present a pair of inclined wedge-like side surfaces 111, 112 (FIG. 10) which are closer together at radially inward locations and widened apart and are tapered upwardly along the axial length of the ramps 110.

The ramps are selectively receivable within one of a pair of mating, arcuately spaced ramp receiving wedge-shaped recesses 115 formed in the inner surface of the blade clamp 102, as best seen in FIG. 9. The arcuate spacing of the recesses 115 corresponds to the desired selected pitch positions of the blade 95, and thus these recesses, for example in a 52" fan, may provide for a total of 30° of pitch angle adjustment of the blade, that is, approximately 15° either side of a flat pitch or a neutral position. Immediately radially outwardly of each of the recesses 115 in the clamp 102, there are provided arcuate relieved openings or slots 120 which are proportioned to receive the respective ramps 110, and provide for relative angular movement of the ramps between the recesses 115, when the blade iron is depressed inwardly, as shown in FIG. 5.

The clearance opening 106 in the member 85 is formed with a sufficient transverse dimension so as to permit the selective movement of the assembled blade clamp 102 and blade iron 90 both rotationally and axially. Additionally, the axial dimension of the clearance opening 106 is more than sufficient to ensure the engagement of the inclined surfaces of the ramps 110 with their respective recesses 115. The clamp 102 is provided with an inwardly extending peripheral lip 128 which is received within a corresponding marginal slot formed in the blade clamp portion 100 for the purpose of accurately locating and positioning the blade iron clamp 102 thereon.

A compression coil spring 130 is received between the terminal outer end of the support member 85 and the closed end 132 of the clamp 102. The spring 130 is compressed with the movement of the blade iron radially inwardly as shown in FIG. 5 and urges the parts apart, and urging the ramps 110 into camming engagement with the cam recesses 115, to define a located and preselected position as shown in FIG. 6. The inner surface of the extension 100 is provided with a pair of longitudinal locating ribs or rails 135 and 136, as best shown in FIGS. 7 and 8. The ribs 135 and 136 engage the lower cylindrical surface of the extension member 85 and accurately locate the member 85 with respect to the blade iron 90 when the neutral cam surfaces are engaged.

It is also desirable to provide additional locator means to prevent the blades 95 from being rotated, in adjustment, to pitch position substantially beyond that of the postions defined by the ramps 110 and recesses 115, and further to protect the mutually engaging ramp and recess surface from unintentional damage. For this purpose, the support member 85 is provided with a downwardly extending locator tab 140, as best shown in FIG. 8. The locator tab 140 is movable into either one of a pair of locator-receiving axially extending slots 142 formed in the portion 100, and is similarly movable into a clearance space 144 as shown in FIG. 5, when the blade 95 is depressed for adjustment purposes in the direction of the arrow 108. The locator 140, in cooperation with the selected pairs of slots 142, is not intended to provide a camming or a tight interfitting action for the purpose of removing play and providing a vibration-free, long lasting assembly. This is provided by the mutually engaging tapered cam surfaces of the ramps 110 and the corresponding tapered surfaces of the recesses 115 in cooperation with the axially extending locating ribs 135 and 136. Rather, the locator means provided by the locator tab 140 and the slots 142 assures that the cam elements are always placed in their relieved areas, and prevent inadvertent rotation or stripping of these parts without first depressing the blade 95 and blade iron 90 radially inwardly so that the parts line up with their respective relieved areas. They also assure that the blade cannot be twisted into pitch positions which are substantially outside of the desired selection of range.

In the operation of the embodiment of FIGS. 4–10, the blade iron 90 is pushed radially inwardly, thus moving the ramps 110 out of their respective recesses 115 and into the clearance slots 120. This same movement moves the locator 140 into its clearance space 144, accompanied by the compression of the spring 130. When the blade is rotated and released, the ramps 110 will align themselves into their respective recesses 115 and will come to rest in such a manner that the inclined surfaces 111 and 112 are mutually engaged in cam-like fashion with the corresponding surfaces of the recesses 115, while the extension member 85 is firmly pressed against the ribs 135 and 136. The centrifugal force of the rotating blades tends to ensure the engagement of the respective ramps in their camming position, thus defining a vibration-free, fixed pitch position for the blades which may be maintained over long extended periods of time. The employment of a pair of the ramps 110 in axially spaced relation with respect to the retainer bolt 105 assures that there is no rocking action of the blade irons on the supports 80 as the blades are rotated and driven by the motor.

The clearance opening 106 is somewhat axially longer than the movements required to change the pitch position of the blade, so as not to interfere with such adjusting movement. In the unlikely event that the screw 105 should become loose, permitting the ramps 110 to leave the recesses 115, the screw will engage the forward recess wall and will prevent the blade 95 and iron 90 from slipping off of the support 80.

While the forms of apparatus herein described constitute preferred embodiments of the invention, it is to be understood that the invention is not limited to these precise forms of apparatus, and that changes may be made therein without departing from the scope of the invention.

What is claimed is:

1. A two-position blade attachment arrangement for attaching and securing the paddle wheel fan blades of a ceiling fan at two selectable angular positions on a rotating fan blade support member comprising:

a fan blade bracket adapted for mounting to a rotating fan blade support member, such as to a motor shaft or armature element, said fan blade bracket having a radially outwardly extending blade bracket support member, a blade bracket having one end adapted for connection to a paddle-type blade and having another end adapted to be received in interfitting relation to said blade bracket support member providing for translational axial movement thereon while providing for limited angular movement generally about a radial center line of said blade between two defined angular positions, detent means mutually engageable between said blade bracket and said fan bracket for retaining said blade bracket and the associated paddle blade thereon in either of two predetermined angular positions, said detent means including means in said blade bracket defining a pair of radially spaced grooves, and means on said blade bracket support member defining a groove-engaging cam receivable selectively in one of said radially spaced grooves, said grooves and cam being provided with an inclination to said transverse axis whereby centrifugal force tends to cause engagement therebetween.

2. A two position fan blade support attachment for ceiling fans comprising a fan bracket adapted to be mounted to a rotating fan drive member such as a rotor cage, said fan bracket having a generally radially outwardly extending, generally cylindrical blade iron support portion, a blade iron adapted for mounting to a paddle-type blade and having an end adapted to be received in partially encircling relation to said support portion, a clamp member proportioned to be received over said support portion on said blade iron end, means for retaining said clamp member on said blade iron end, inclined ramp means formed on said blade iron support portion, means in said clamp member defining a pair of inclined recesses, said clamp member being selectively engageable with said ramp means at one or the other of said recesses with axial outward movement of said blade iron to define a pair of preselected blade positions, clearance means on said clamp member adjacent said recesses into which said ramp means may move with limited inward axial movement of said blade iron and clamp member on said bracket providing for limited rotational movement of said blade iron on said bracket for selecting either of said positions, and spring means urging said blade iron axially outwardly assuring the engagement of said ramp means with one or the other of said recesses and in the direction of the application of centrifugal force during rotation of the fan, for positively maintaining a selected position with a minimum of free play.

3. The blade support attachment of claim 2 further comprising locator means on said cylindrical support portion, a pair of selectable groove means in said blade iron selectively engageable by said locator means in each of said selected positions, clearance means in said blade iron adjacent said locator means providing for rotational movement of said locator means with rotation of said blade iron and defining the limits of rotation, said locator means assuring the alignment and engagement of said ramp means with the selected one of said recesses with axial return movement of said blade iron on said blade bracket.

4. The blade support attachment of claim 3 further comprising a locator tab on said cylindrical support portion, means in said blade iron end defining a pair of selectable grooves selectively engageable by said locator tab in each of said selected positions, means in said blade iron end defining a clearance recess opening into said grooves and providing for rotational movement of said locator tab with rotation of said blade iron and having walls defining the limits of rotation, said locator tab assuring the alignment and engagement of said ramps with the selected one of said recesses with outward movement of said blae iron on said blade bracket under the influence of said spring.

5. A fan blade support attachment for ceiling fans providing for the selection of two pitch positions of the fan blade, comprising a fan bracket adapted to be mounted to a rotating fan drive member such as a rotor cage, said fan bracket having an outwardly extending blade iron support portion, a blade iron adapted for mounting to a paddle-type blade and having an end adapted to be received in partially encircling relation to said support portion, a clamp member proportioned to be received over said support portion on said blade iron end, means for retaining said clamp member on said blade iron end, a pair of inclined ramps formed on said blade iron support portion in axially spaced relation, means in said clamp member defining a pair of inclined recesses for each of said ramps, said recesses being selectively engageable with the associated said ramp with outward movement of said blade iron to define a pair of preselected blade positions, a clearance relief on said clamp member adjacent said recesses into which the associated said ramp may move with limited telescoping inward movement of said blade iron and clamp member on said bracket blade iron support portion providing for limited rotational movement of said blade iron on said bracket for selecting either of said positions, a compression spring between said support portion and said blade iron urging said blade iron outwardly assuring the engagement of said ramps with selected one of said recesses and in the direction of the application of centrifugal force during rotation of the fan, for positively maintaining a selected position with a minimum of free play.

* * * * *

UNITED STATES PATENT AND TRADEMARK OFFICE

CERTIFICATE OF CORRECTION

PATENT NO. : 4,396,352

DATED : August 2, 1983

INVENTOR(S) : Richard A. Pearce

It is certified that error appears in the above-identified patent and that said Letters Patent are hereby corrected as shown below:

Item [73] Assignee: Change "TRW Inc." to -- Robbins & Myers, Inc. --.

Col. 2, line 29, change "engable" to -- engageable --.

Col. 4, line 19, change "moment" to -- movement --;
line 20, change "moment" to -- movement --.

Col. 6, line 21, change "postions" to -- positions --.

Col. 8, line 43, change "blae" to -- blade --.

Signed and Sealed this

*Twenty-fifth* Day of *December 1984*

[SEAL]

*Attest:*

*Attesting Officer*

GERALD J. MOSSINGHOFF

*Commissioner of Patents and Trademarks*